US012295508B1

(12) United States Patent
Olive et al.

(10) Patent No.: US 12,295,508 B1
(45) Date of Patent: May 13, 2025

(54) MODULAR DISPLAY STAND FOR HOLDING MEDIA COLLECTIBLES

(71) Applicants: Robert Daniel Olive, Naples, FL (US); Jason Robert Patry, Indian Rocks Beach, FL (US)

(72) Inventors: Robert Daniel Olive, Naples, FL (US); Jason Robert Patry, Indian Rocks Beach, FL (US)

( * ) Notice: Subject to any disclaimer, the term of this patent is extended or adjusted under 35 U.S.C. 154(b) by 0 days.

(21) Appl. No.: 18/655,287

(22) Filed: May 5, 2024

(51) Int. Cl.
*A47F 7/00* (2006.01)
*A47F 5/10* (2006.01)

(52) U.S. Cl.
CPC ..... *A47F 7/0042* (2013.01); *A47F 5/108* (2013.01)

(58) Field of Classification Search
CPC ..... A47F 7/0042; A47F 5/108; A47F 7/145; A47F 7/163
USPC ..... 211/43, 41.7, 40, 41.12, 10, 11, 42; 248/447, 453, 455, 473; 206/577, 579
See application file for complete search history.

(56) References Cited

U.S. PATENT DOCUMENTS 1,511,731 A * 10/1924 Kimmel ..... A63F 9/20 273/150
2,454,516 A * 11/1948 Laureyns ..... A47J 47/16 211/40
2,829,651 A * 4/1958 Loring ..... B42F 13/04 211/50
3,999,734 A * 12/1976 Gibson ..... A47F 7/142 211/2
4,145,022 A * 3/1979 Comfort ..... A47B 23/042 D19/91
4,291,882 A * 9/1981 Del Monte ..... A63F 3/06 40/606.03
4,295,623 A * 10/1981 Schweizer ..... G11B 23/0236 211/175
4,453,714 A * 6/1984 Houser ..... A63F 3/06 273/148 A
4,468,032 A * 8/1984 Stewart ..... A63F 1/10 40/124.4
4,555,084 A * 11/1985 Anderson ..... A47B 25/00 248/455
4,685,647 A * 8/1987 Calhoun ..... A47B 23/042 248/444.1
4,948,082 A * 8/1990 Pagano ..... A47B 23/044 248/447.2
4,957,263 A * 9/1990 Leluan, Jr. ..... A47F 7/0064 248/176.1
4,976,409 A * 12/1990 Hansen ..... A47G 1/14 248/498
5,295,596 A * 3/1994 Squitieri ..... A47B 45/00 211/175
D353,412 S * 12/1994 Bull ..... D21/392
5,497,971 A * 3/1996 Spiro ..... A47B 23/043 248/455
5,513,456 A * 5/1996 Gleason ..... G09F 7/10 40/594
5,918,907 A * 7/1999 Ho ..... B42D 17/00 248/455

(Continued)

*Primary Examiner* — Jennifer E. Novosad

(57) ABSTRACT

A modular display stand designed to showcase multiple collectibles such as comics, cards, graded comics, books, and other items. The stand features a unique design that allows for variable sizing, easy assembly, and efficient storage. Utilizing magnetic connections, hinged legs, and adjustable wings, the stand provides stability, versatility, and enhanced visibility for displayed items.

3 Claims, 3 Drawing Sheets

(56) References Cited

U.S. PATENT DOCUMENTS

| | | | | | |
|---|---|---|---|---|---|
| 6,142,315 | A * | 11/2000 | Arout | A47F 7/145 | |
| | | | | 248/473 | |
| 6,805,249 | B1 * | 10/2004 | Houle | A47F 7/145 | |
| | | | | D6/407 | |
| D542,860 | S * | 5/2007 | Davis | D21/392 | |
| 10,028,596 | B2 * | 7/2018 | Markwick | G09F 7/08 | |
| 10,420,419 | B2 * | 9/2019 | Kasravi | A47B 21/045 | |

* cited by examiner

MODULAR DISPLAY STAND FOR HOLDING MEDIA COLLECTIBLES

BACKGROUND OF THE INVENTION

Field of the Invention

The present invention relates to a modular display stand for showcasing multiple collectibles, including but not limited to comics, cards, graded comics, books, and other items. Traditional display stands often lack flexibility in size adjustment, stability, and efficient storage options. The proposed modular display stand addresses these limitations by incorporating magnetic connectors, hinged legs, wiper blades, and foldable wings to enhance versatility, stability, and space efficiency.

Description of the Related Art

U.S. patent application U.S. Pat. No. 7,316,085B1 Richard Stewart Freeman published 2004. A self-standing display device for providing a viewer with a printed image which can be easily removed from any print medium such as a magazine or book, simply folded and placed on self-standing long-term display. The self-standing display may have support panels with a straight or flat base in which case it forms a stationery display, or it may have side support panels with a curved bottom edge in which case it forms a display which can be rocked back and forth to enhance the display of animated or other specialized images.

But this prior art has a lot of limitations like limited Stability. While the device may provide self-standing capability, particularly with support panels with a straight or flat base, it lacks stability compared to the mounting method of the superior stand. Limited longevity. The repeated folding and unfolding of the printed image for placement on the self-standing display could lead to wear and tear over time, diminishing the quality and longevity of the image. Additionally, the self-standing display itself may degrade with prolonged use, particularly if made from less durable materials. While the self-standing display device offers convenience in terms of portability and ease of placement, it also occupies significant space on surfaces such as desks, shelves, or countertops. This could be a disadvantage in environments where space is limited or where clutter needs to be minimized.

SUMMARY

The superior stand consists of several key components, including a base unit, one or more extension units, hinged legs, adjustable wings, and wiper blades. The base unit serves as the foundational element of the stand and is equipped with magnetic connectors designed to attach extension units. This magnetic connection system allows for easy customization of the stand's size according to the user's collection.

The hinged legs play a crucial role in providing support to the bottom base of the stand, thereby ensuring stability on various surfaces. Additionally, these legs are designed to fold inward, facilitating compact storage when the stand is not in use. The adjustable wings are another integral feature of the stand, capable of folding out to accommodate larger items and folding in to conserve space when displaying smaller items. This versatility in display options enhances the stand's functionality.

Furthermore, wiper blades positioned towards the top of the stand serve to assist in the upright display of books, preventing them from slouching or falling over. This innovative feature significantly improves the visibility and presentation of the displayed items, ensuring they are showcased in optimal condition.

DETAILED DESCRIPTION

The modular display stand is constructed from durable materials such as plastic. The base unit comprises a flat surface with magnetic connectors embedded along its edges. Extension units are identical in design to the base unit and can be attached or detached via the magnetic connectors to adjust the length of the stand. Hinged legs are attached to the underside of the base unit, providing support and stability. The legs feature hinges that allow them to fold inward when not in use, minimizing the footprint of the stand for storage purposes. Wiper blades are integrated into the top portion of the stand, consisting of flexible materials such as rubber or silicone. These blades serve to gently press against the spine of books or other upright items, ensuring they remain in an upright position and enhancing their visibility on the display stand. Foldable wings are located on either side of the stand and can be extended or retracted to accommodate the size of the displayed collectibles. When not in use, the wings can be folded inward to reduce the overall width of the stand, optimizing space utilization.

Advantages

Versatile Sizing: The modular design allows for easy adjustment of the stand's length to accommodate various collections.

Stability: Hinged legs provide sturdy support to the base unit, ensuring the stand remains upright even when displaying heavier items.

Enhanced Visibility: Wiper blades help maintain the upright position of books and other items, improving their visibility and presentation.

Space Efficiency: Foldable wings and legs enable compact storage when the stand is not in use, saving space for the user.

DETAILED DESCRIPTION OF DRAWINGS

Figure 1:
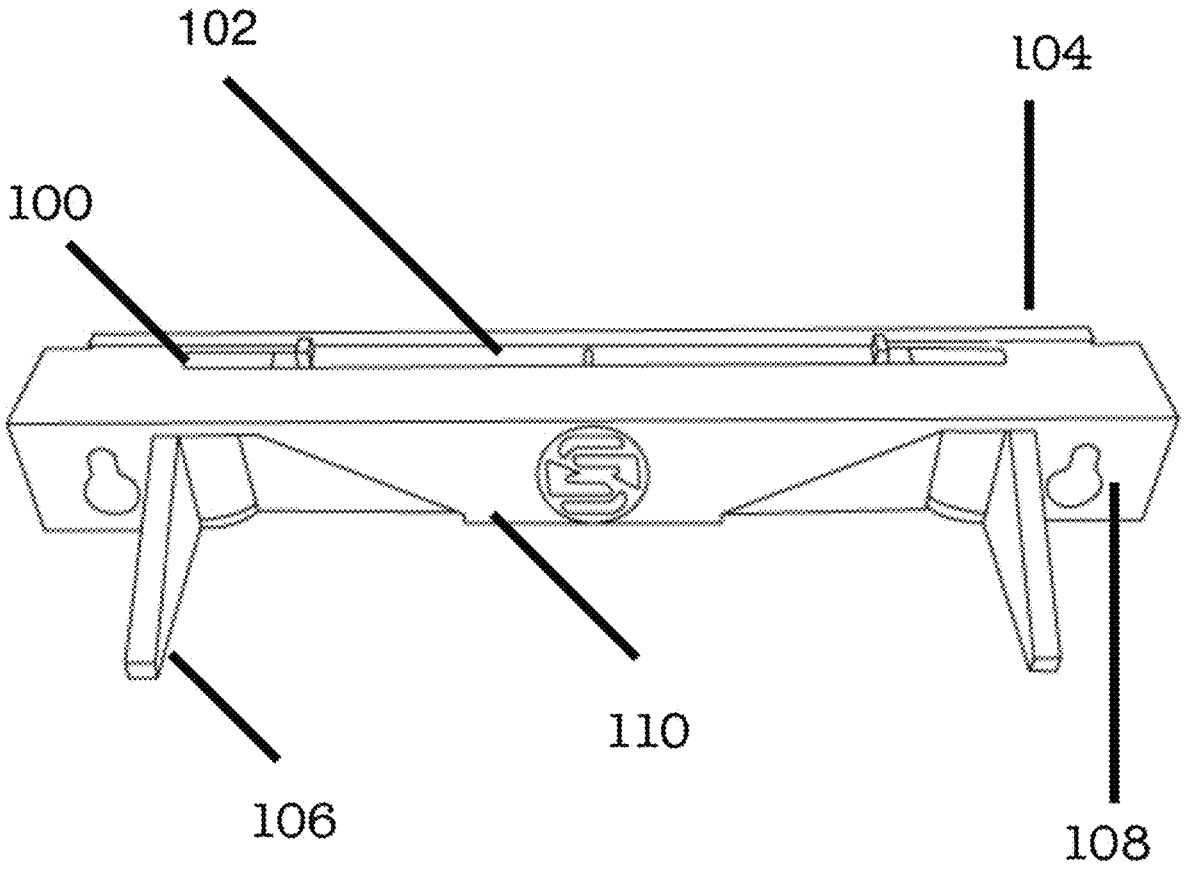
FIG. 1 is a perspective view of invention.

FIG. 1. The modular display stand comprises 110 base unit, 104 extension units, 106 hinged legs, 102 wiper blades, 100 adjustable wings and 108 hanging wings. The 110 base unit serves as the foundation and features magnetic connectors for attaching 104 extension units. The 104 extension units allow for customizable sizing based on the user's collection. 106 Hinged legs provide stability to the bottom base and can be folded inward for compact storage. 102 Wiper blades positioned toward the top of the stand assist in displaying books upright, enhancing visibility and presentation. 108 Hanging wings adjust to accommodate varying sizes of collectibles and reduce space when not in use.

Figure 2:
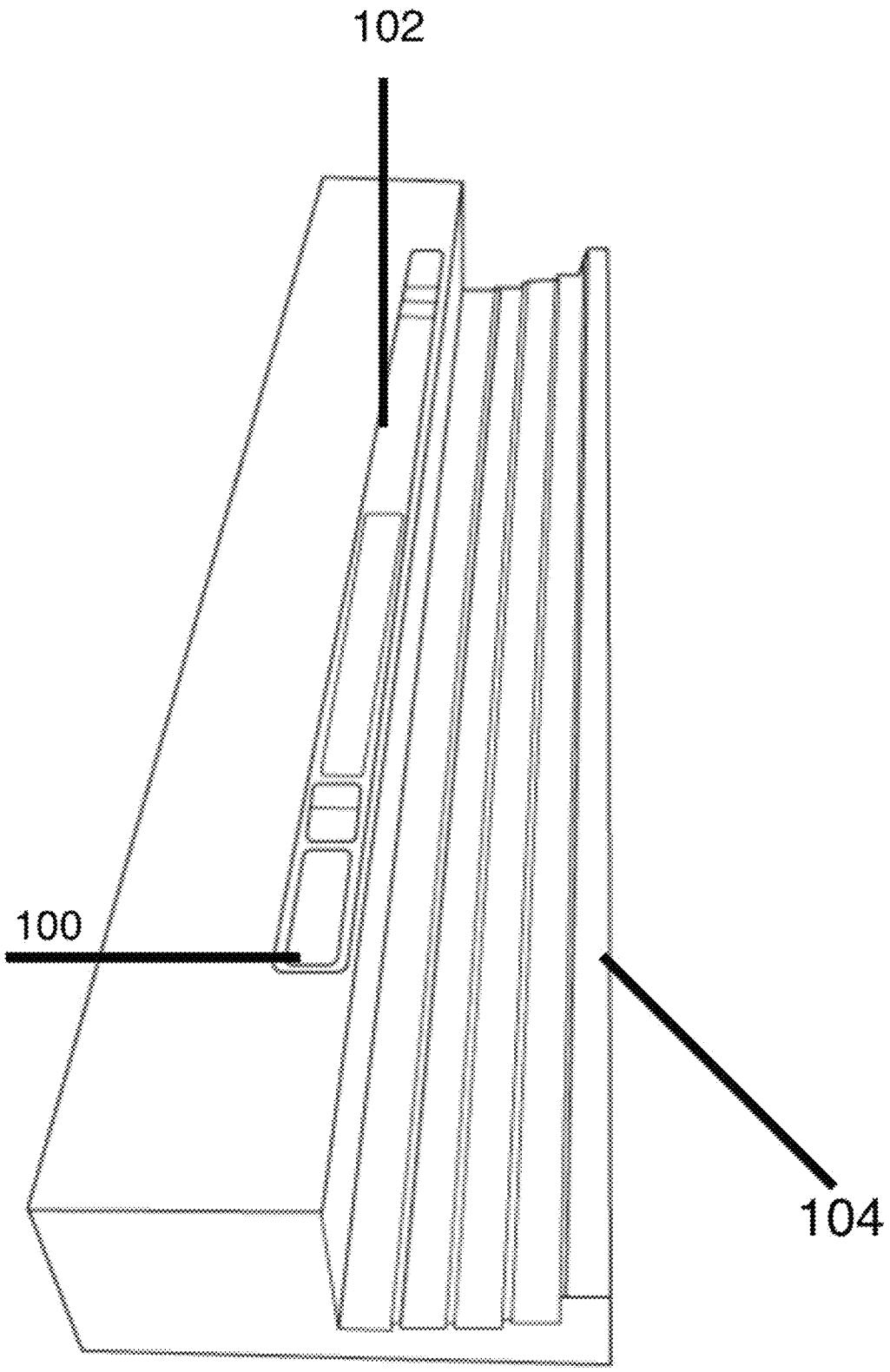
FIG. 2 is a bottom view of the invention.

FIG. 2 The 100 adjustable wings are another integral feature of the stand, capable of folding out to accommodate larger items and folding in to conserve space when displaying smaller items 102 wiper blades serve as the foundation for the display stand and includes magnetic connectors for attaching extension units. Each 104 extension unit can be easily connected or disconnected from the base unit using magnetic connections, allowing for customizable sizing based on the user's collection.

Figure 3:
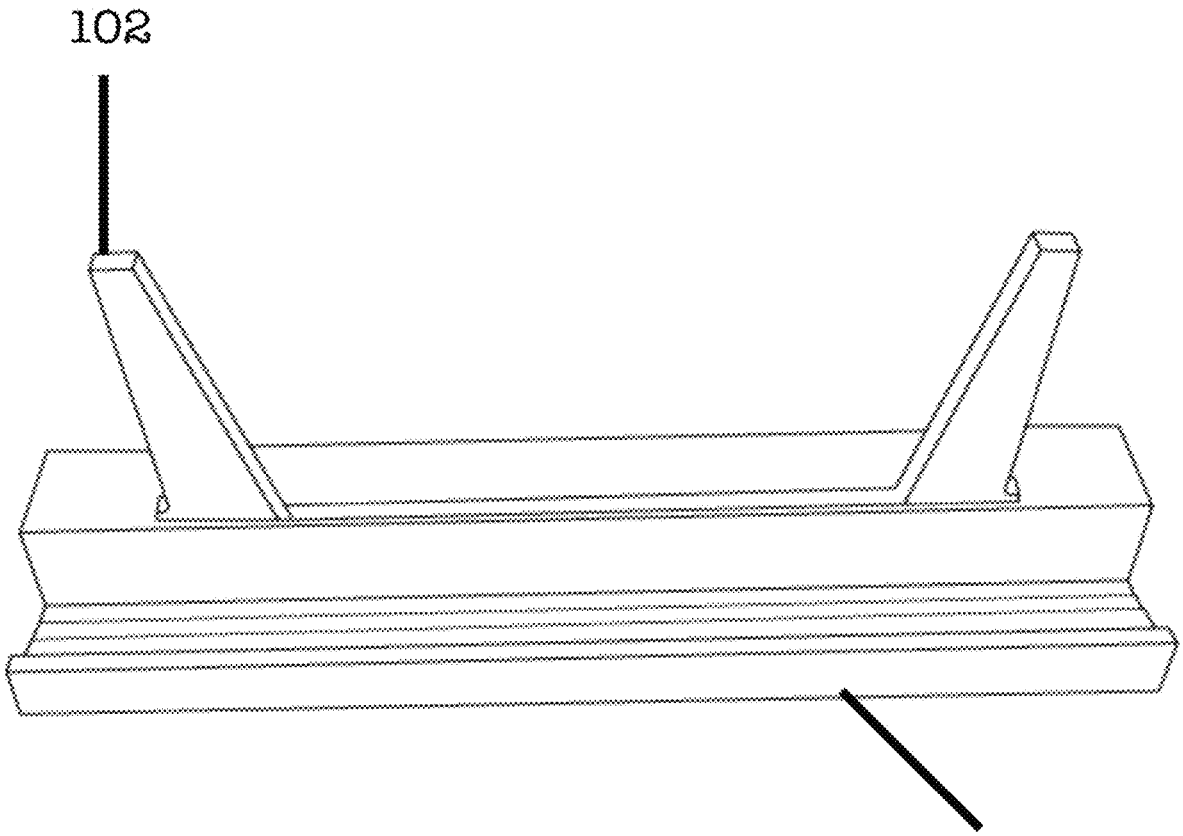
FIG. 3 is an elevated perspective view of the invention.

FIG. 3 The 102 wiper blades wings fold out to accommodate larger items and fold in to reduce space when displaying smaller items, offering flexibility in display options. Furthermore, wiper blades located toward the top of the stand assist in displaying books upright, preventing them from slouching or falling over. This feature enhances the visibility and presentation of displayed items, ensuring they are showcased in their best condition. 104 extension unit works as the front balancing unit. It helps stabilize the display and provides customize.

In conclusion, the proposed modular display stand offers a practical solution for showcasing collectibles of different sizes while addressing the challenges of stability and space efficiency commonly encountered with traditional display stands.

What is claimed:

1. A modular display stand for holding media collectibles, the stand comprising:

(a) a base unit having a rear side, a bottom side, a left side, a right side, and a top surface defining a first top portion and a second top portion defined forwardly and below the first top portion, (b) the rear side comprising at least two retractable legs hinged to the rear side that are foldable away and toward the rear side and are stored within mating areas defined in the rear side when folded toward the rear side, and at least two mounting elements adjacent each of the left and right sides;

(c) the first top portion comprising an elongated channel and two elongated wiper blades fabricated from a flexible material that are foldable away and toward the first top portion and are stored within the elongated channel when folded toward the first top portion, and the second top portion comprising a stepped surface extending between the left and right sides;

(d) each of the left side and right side comprising magnetic connectors embedded therein allowing for additional base units to be connected to the base unit on the left and right sides to selectively adjust a length of the modular display stand;

wherein the stand is adapted to be selectively placed in both a freestanding configuration and a wall mounted configuration;

wherein when the stand is selectively placed in the freestanding configuration the bottom side is supported upon a substantially horizontally extending surface, the two retractable legs are selectively folded outwardly away from the rear side to provide stability on the substantially horizontally extending surface, and when the stand is selectively placed in the wall mounted configuration the two retractable legs are folded inwardly within the mating areas and the rear side is placed flush against a substantially vertically extending surface and supported thereupon by the mounting elements, wherein at least one media collectible can be supported upon the stepped surface, and the two wiper blades can be selectively folded away from first top portion to assist in supporting an upright portion of the at least one media collectible.

2. The modular display stand for holding media collectibles according to claim 1, whereby the base unit is fabricated from plastic.

3. The modular display stand for holding media collectibles according to claim 1, whereby the flexible material from which the two wiper blades is fabricated comprises rubber, or silicone, or plastic.

* * * * *